US007073626B2

(12) United States Patent
Weinhold et al.

(10) Patent No.: US 7,073,626 B2
(45) Date of Patent: Jul. 11, 2006

(54) ENGINE EXHAUST MUFFLER WITH GUIDE VANES IMPARTING A SUCCESSIVELY ALTERNATING SPIRAL SWIRL GAS FLOW

(75) Inventors: Peter Weinhold, Roedermark (DE); Peter Wintrich, Roedermark (DE)

(73) Assignee: 3W-Modellmotoren, Roedermark (DE)

( * ) Notice: Subject to any disclaimer, the term of this patent is extended or adjusted under 35 U.S.C. 154(b) by 93 days.

(21) Appl. No.: 10/615,148

(22) Filed: Jul. 7, 2003

(65) Prior Publication Data

US 2004/0065505 A1 Apr. 8, 2004

(30) Foreign Application Priority Data

Jul. 4, 2002 (DE) ..... 102 30 044

(51) Int. Cl.
*F01N 1/12* (2006.01)
*F01N 1/08* (2006.01)

(52) U.S. Cl. ..... 181/279; 181/269; 181/272

(58) Field of Classification Search ..... 181/279–281, 181/269, 270, 272, 274
See application file for complete search history.

(56) References Cited

U.S. PATENT DOCUMENTS 1,340,158 A * 5/1920 Delavan ..... 181/277
1,761,971 A * 6/1930 Cram ..... 181/264
1,797,310 A * 3/1931 Wright ..... 181/280
1,818,469 A * 8/1931 Floyd, Jr. ..... 181/254
2,063,270 A * 12/1936 Bacchetti-Righetti ..... 181/280
2,076,827 A * 4/1937 Ross ..... 181/277
2,158,030 A * 5/1939 Latulippe ..... 181/268
2,359,365 A * 10/1944 Katcher ..... 181/280
2,663,378 A * 12/1953 Keller ..... 181/280
3,966,443 A * 6/1976 Okano et al. ..... 60/282
4,533,015 A * 8/1985 Kojima ..... 181/280
6,588,545 B1 * 7/2003 Lee ..... 181/264

FOREIGN PATENT DOCUMENTS

DE 848877 9/1952
DE 2113678 B * 10/1977
DE 19756468 3/1999
GB 198229 * 5/1923

* cited by examiner

*Primary Examiner*—Edgardo San Martin
(74) *Attorney, Agent, or Firm*—W. F. Fasse; W. G. Fasse

(57) ABSTRACT

A muffler has a housing (2) through which exhaust gas flows and which has at least one housing chamber (3, 5) and in which deflecting elements (13 to 16) serving to make the gas swirl are arranged spaced one behind another along a main axis (19') of the housing in a positionally fixed manner. A disk-shaped body (17') having guide vanes (18) with slots (18') therebetween is provided as each deflecting element (13 to 16) and extends over the clear cross section of the housing (2). The guide vanes of adjacent disk-shaped bodies respectively deflect the flow in opposite directions about the main axis (19') of the housing.

23 Claims, 5 Drawing Sheets

ENGINE EXHAUST MUFFLER WITH GUIDE VANES IMPARTING A SUCCESSIVELY ALTERNATING SPIRAL SWIRL GAS FLOW

FIELD OF THE INVENTION

The invention relates to a muffler which is intended in particular also for internal combustion engines, having a housing through which a gaseous medium flows and which has at least one housing chamber and in which deflecting elements serving to make the gaseous medium swirl are arranged one behind another along an axis of the housing and in a positionally fixed manner at a distance from one another.

BACKGROUND INFORMATION

Mufflers of this type are disclosed, for example, in DE 848 877 and in DE 197 56 468 C1. In the first-mentioned case, locking plates serving as deflecting elements are provided and are inserted into the housing in such a manner that they form labyrinth-like flow paths for the gases without making metallic contact with the housing wall. Furthermore, a muffling material is provided and lines the inner wall of the housing in the form of a lining pad.

In the case of DE 197 56 468, disks, which are similar to fan wheels are arranged in a positionally fixed manner in the housing in order to cause swirling of the gaseous medium. Disk-like insulating segments composed of sound-absorbing material are fitted in each case between two successive disks and have free passage openings.

Furthermore, mufflers are known in which the flow of exhaust gas—in the case of internal combustion engines—is broken up by means of a complex arrangement of pipes and/or perforated intermediate walls and/or damping wool and, if appropriate, by means of additional rear mufflers and the noise produced by the emerging exhaust gas is thereby reduced. It is not possible for these damping systems to be completely satisfactory in respect of the damping action and/or the complexity and/or the adaptability to the particular application.

SUMMARY OF THE INVENTION

Accordingly, the invention is based on the object of providing a muffler which is of particularly simple construction and, firstly, consists of simply designed elements and, secondly, is particularly effective and flexible, with the result that it can also easily be adapted to different operating conditions.

To achieve this object, the invention provides a respective disk-shaped body having slots as each deflecting element. Each disk-shaped body extends over the cross section of the housing chamber, and includes guiding elements which bound the slots, and which have the form of guide vanes. The guide vanes of adjacent or successive disk-shaped bodies are respectively pitched or angled in opposite directions so as to deflect the flow in opposite directions with respect to the main axis of the housing.

A muffler of this type manages without the use of sound-absorbing material. Neither lining pads on the inner walls of the housing nor insulating elements consisting of sound-absorbing material between the deflecting elements are required. Just deflecting the flow with the aid of the guiding elements in the manner of guide vanes causes sound to be absorbed, in which case sound vibrations cancel one another out. This is achieved especially by different setting angles, in particular if the guiding elements of adjacent, disk-shaped bodies are in each case preferably angled in an opposite direction to one another.

According to the invention, deviations and deflections and also swirling of the gas flow therefore take place in the present case in such a manner that good muffling is produced.

At the same time, the muffler is of simple and compact construction especially when disk-shaped bodies in the form of circular rings in an axial arrangement one behind another are used.

Furthermore, the muffling effect can be adapted without any problem to the particular requirements, for which purpose the number of slotted deflecting elements and/or the number of guiding elements in the form of guide vanes per deflecting element and/or the shape and design of the guiding elements and/or the setting angles of the guiding elements and/or the orientation of the setting angle between adjacent deflecting elements can be changed. This permits specific adaptation to each application or to different engines in a simple manner.

BRIEF DESCRIPTION OF THE DRAWINGS

The invention will be explained in greater detail below with reference to exemplary embodiments which are illustrated in the drawing, in which, in each case schematically.

DETAILED DESCRIPTION OF A PREFERRED EXAMPLE EMBODIMENT OF THE INVENTION

Figure 1:
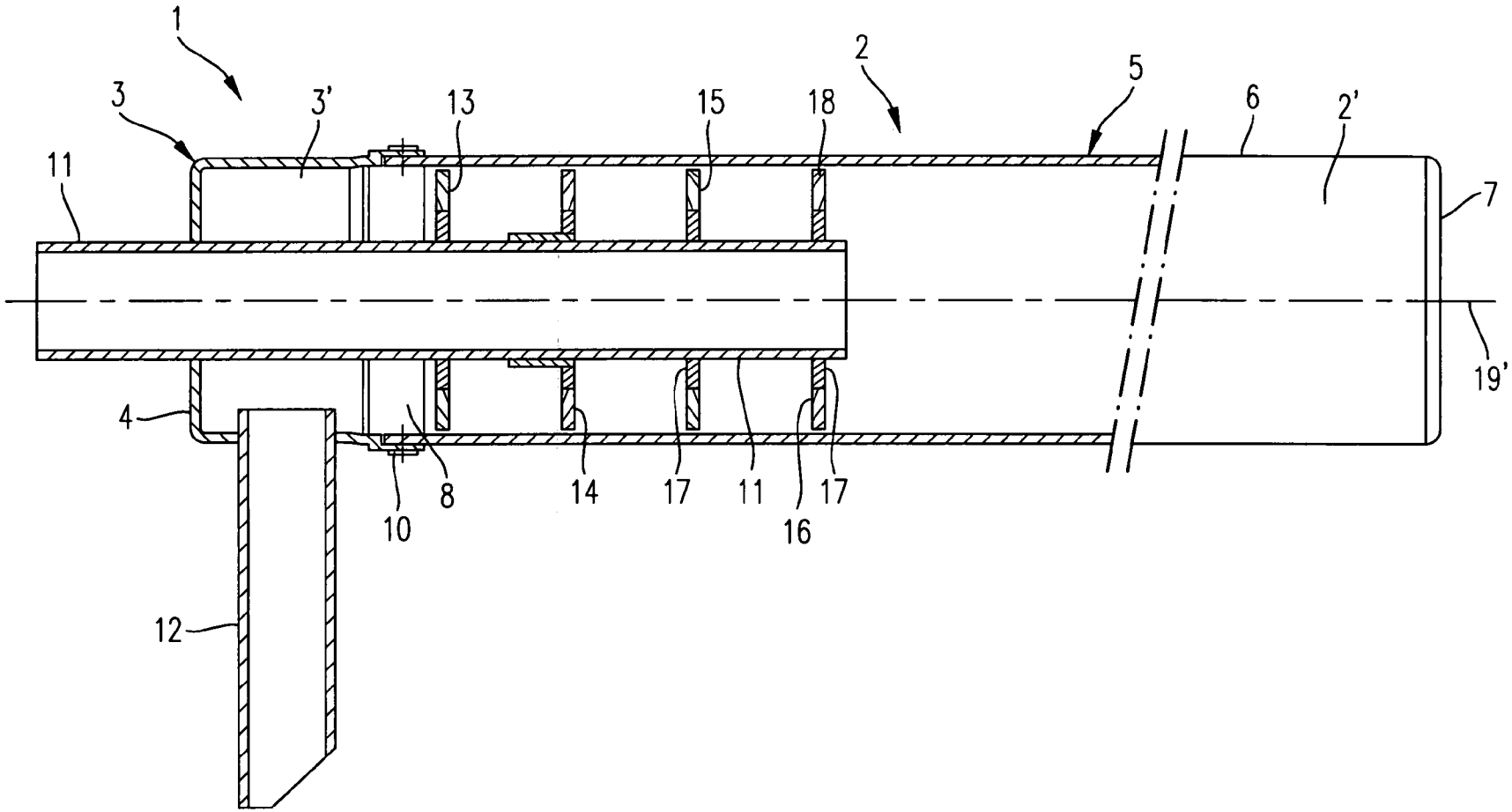
FIG. 1 shows a muffler in section.

A muffler 1 comprises a housing 2 having at least one housing part or a housing chamber. The housing 2 is formed by a pot-shaped head element 3, which serves as the housing chamber and has a front end wall 4, and by a cup-shaped housing part 5, which likewise serves as the housing chamber. The housing 2 furthermore has a cylindrical circumferential wall 6 and an end wall 7 at its one end. According to the exemplary embodiments illustrated in FIGS. 1 and 2, a fastening edge 8 having a slightly larger diameter and having fastening holes distributed in the circumferential direction is situated on the head element 3. The housing part 5 is pushed with its open end under the fastening edge 8 of the head element 3 until it makes contact. In the fitted position, the head element 3 and the housing part 5 are connected fixedly to each other. For this purpose, fastening means 10 which extend through the fastening holes are provided. Screw bolts or else rivets are suitable as fastening means 10.

According to the exemplary embodiment, a supporting pipe 11 having a circular cross section extends along an axis of the housing through the end wall 4 at the head end and through the head element 3. The supporting pipe 11 protrudes with its one end outward through the end wall 4 where it forms an inlet stub, while its other, likewise open end ends inside the housing 2 at a distance from the end wall 7 (FIG. 1).

In the operating state, the gaseous medium/exhaust gas flows through the supporting pipe 11 into the housing 2 and emerges from the housing 2 through an outlet stub/outflow stub 12. This outflow stub 12 can be fastened to the head element 3 in a radial arrangement and can be open outward and toward the interior of the housing 2.

Figure 2:
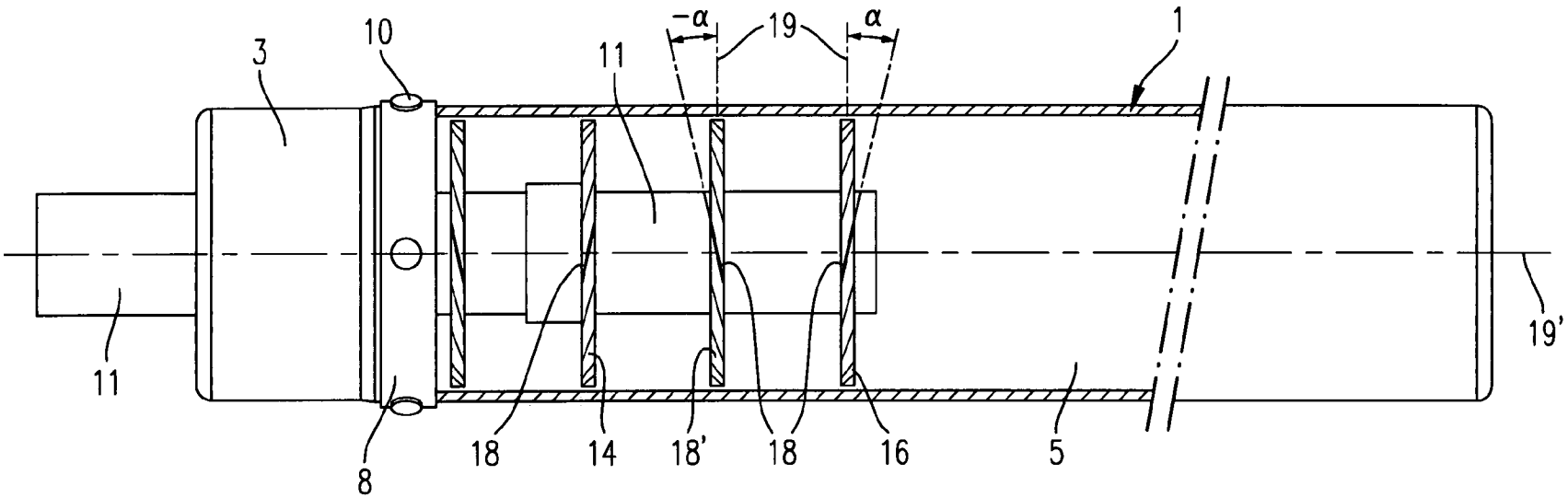
FIG. 2 shows a different view of the muffler according to FIG. 1 with the housing partially broken away and in a simplified illustration.
Figure 5:
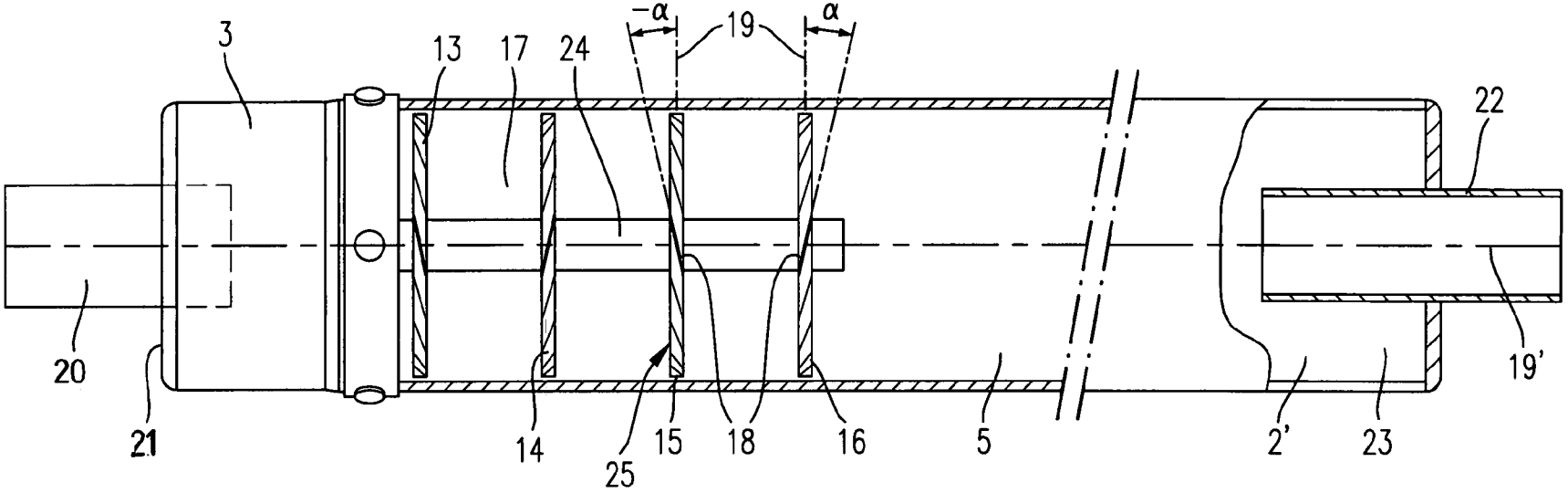
FIG. 5 shows, partially cut away, a muffler which has been slightly modified in comparison to FIG. 1 and has an alternative throughflow direction.

According to the exemplary embodiments illustrated in FIGS. 1 and 2, and 5, four deflecting elements 13, 14, 15 and 16 in the manner of impellers are provided as sound-absorbing or swirling elements. According to the exemplary embodiment, said deflecting elements can be pushed in each case by means of a bushing-shaped or annular hub part 17 onto the supporting pipe 11. They are arranged in a rotationally fixed or positionally fixed manner on the supporting pipe 11, it being possible for this to be achieved by a positive or nonpositive connection between the hub parts 17 and the supporting pipe 12 or else by a separate locking means.

Each deflecting element 13 to 16 in the manner of an impeller forms a muffler stage and has a plurality of guiding elements 18 in the manner of impellers or guide vanes. According to the exemplary embodiments illustrated in FIGS. 1 to 5, the deflecting elements 13 to 16' are in each case disk-shaped and slotted bodies 17' with in each case approximately 20 guiding elements 18 in the manner of guide vanes. The deflecting elements 13 and the disk-shaped slotted bodies 17' are expediently integral in each case with their guiding elements in the manner of guide vanes. They extend in the housing 2 as far as the cylindrical circumferential wall 6.

The guiding elements 18 of each deflecting element 13 to 16 are inclined or angled at a uniform setting angle $\alpha$ of, for example, 15° with respect to the respectively associated radial planes 19. The setting angles $\alpha$ of respectively adjacent deflecting elements are expediently set positively or negatively, as emerges from FIG. 2. A flow which is originally essentially directed axially is therefore correspondingly deflected in each case.

In the starting state, the disk-shaped bodies 17' are flat sheet-metal rings and, as disk blank, obtain narrow slots 18' which extend radially and rectilinearly from the outside to the inside. Owing to the slots 18' and owing to the circular-ring shape of the disk-shaped bodies 17', the guiding elements 18 are in each case in the form of a sector of a circular ring. The positive and/or negative setting angles of the guiding elements mean that there are slot-shaped passage openings in each deflecting element with the effect of enabling the gaseous medium to flow through the deflecting elements 13 to 16 in the longitudinal direction of the housing 2 irrespective of the respective deviations.

Figure 3:
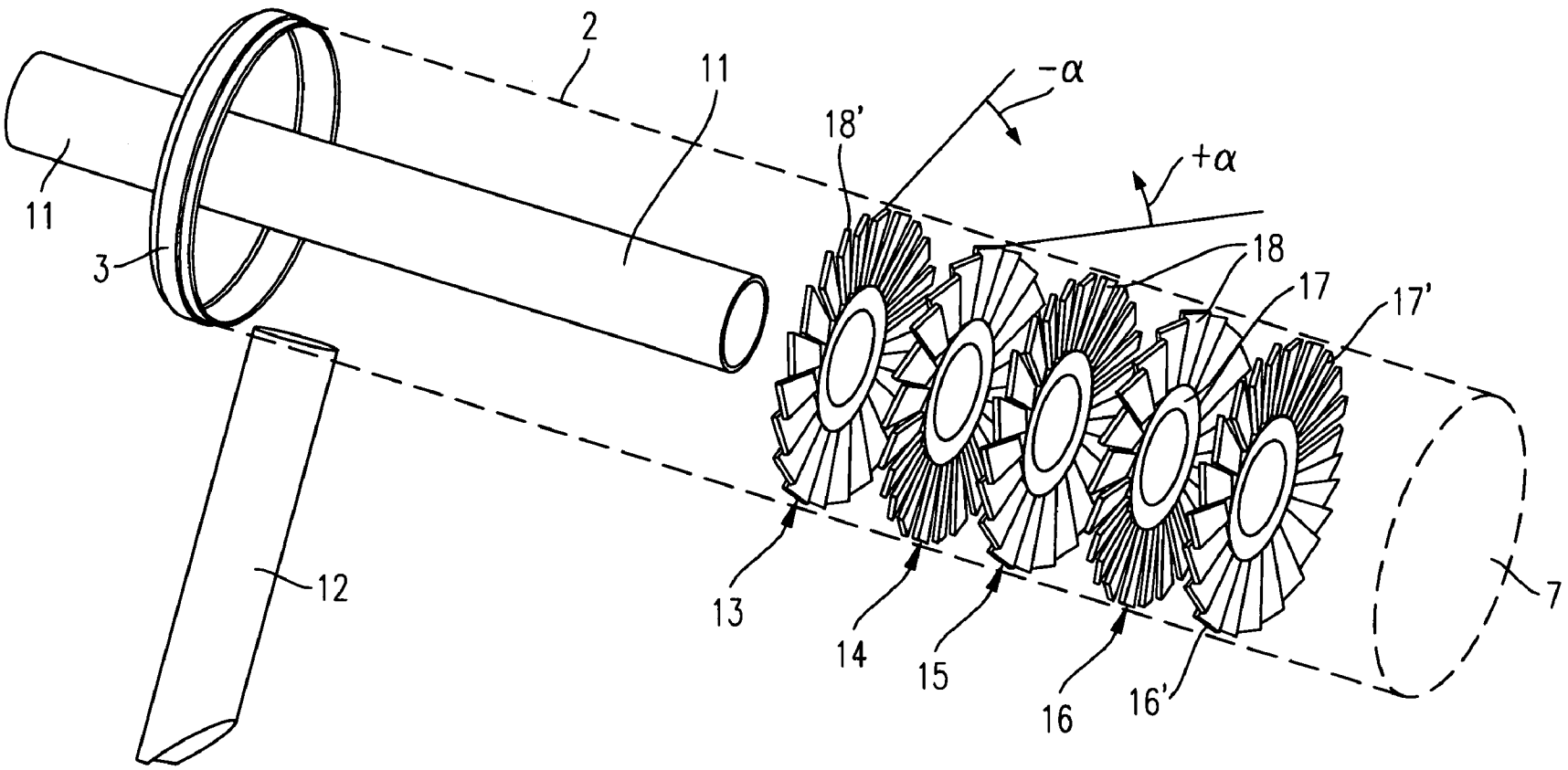
FIG. 3 shows a perspective illustration on an enlarged scale of a modified muffler with the housing indicated by dashed lines and with five disk-shaped deflecting elements which are illustrated pulled apart in an exploded manner and have guiding elements.
Figure 4:
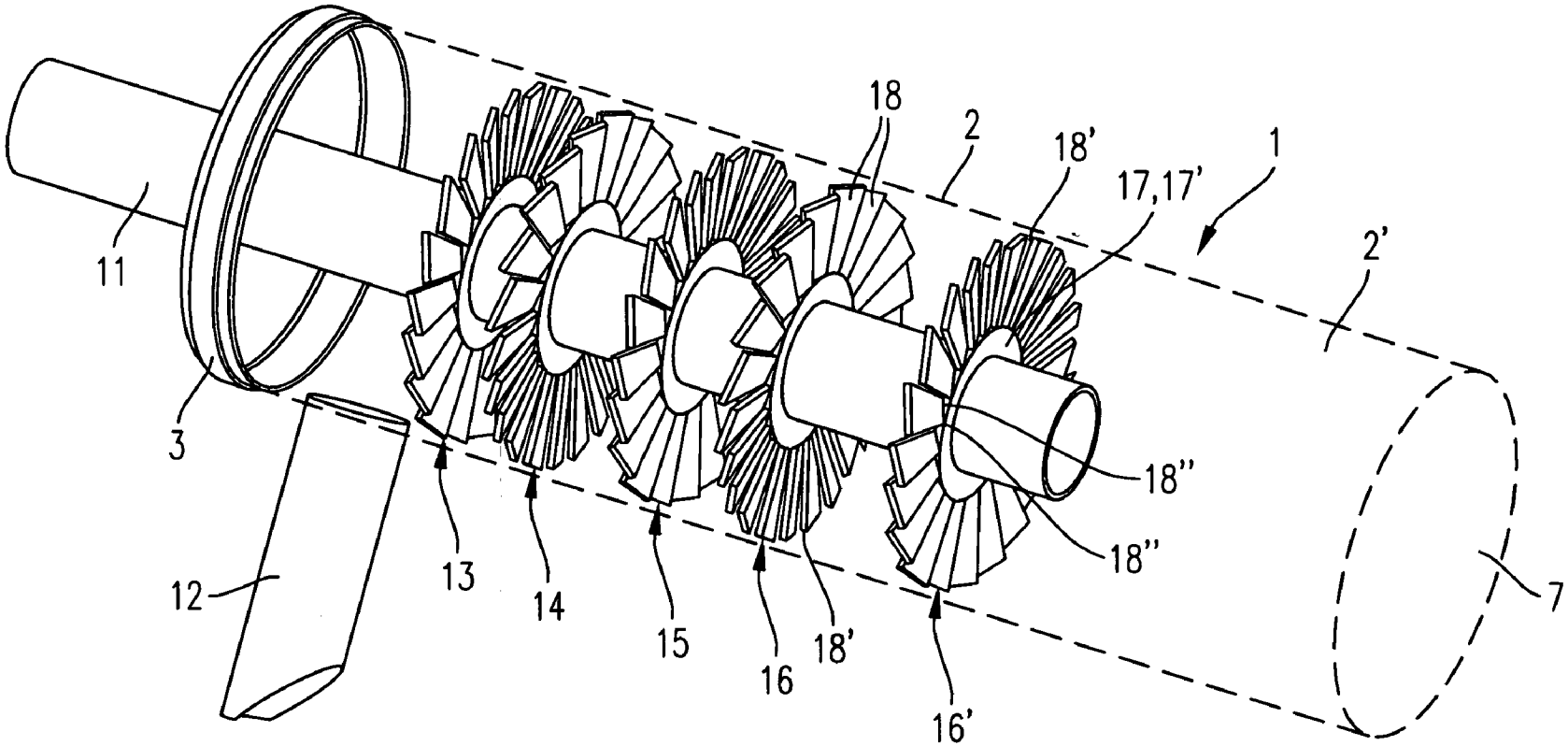
FIG. 4 shows an illustration corresponding to FIG. 3, again on an enlarged scale, with deflecting elements in the operating position with five stages or deflecting elements and with some of them at a different axial distance from one another.

As shown in FIGS. 3, 4 and 5, each sector-shaped guide vane 18 thus has a free leading edge and a free trailing edge, with a respective open slot 18' formed between the trailing edge of one guide vane 18 and the neighboring leading edge of the neighboring guide vane 18 of a given deflecting element 13, 14, 15 or 16.

The illustrations int he figures show that the housing 2 of the muffler 1 does not have to be completely occupied with deflectisng elemnts having guiding elements 18 corresponding to the elements 13 to 16. Although the deflecting elements 13 to 16, 16' are arranged one behind another along the main axis 19' of the housing and in a positionally fixed manner at a distance from one another in order to make the flow medium swirl, the housing 2 nevertheless preferably has a completely unoccupied housing chamber part 2'. The housing chamber part 2' serves as a calming section.

In FIGS. 1 and 2, a comparatively short supporting pipe 11 (for four deflecting elements 13 to 16) is provided in conjunction with a comparatively long housing part 5 which could accommodate double or even triple the number of deflecting elements. It may therefore be expedient, in order to utilize the possibilities arising from the compact construction in conjunction with the variation in the number of deflecting elements, to provide for the head element 3 different housing parts 2 and supporting pipes 11 having a graduated length which are then assembled as a function of the particular application.

Likewise, deflecting elements having guiding elements which differ in terms of their number, their shape and their setting angle, may also be provided for selection to adapt them to the application conditions.

Whereas the direction of flow of the gaseous medium in the case of the muffler 1, which is illustrated in FIG. 1 as an exemplary embodiment, is directed from the outer opening of the supporting pipe 11 into the interior of the cup-shaped housing part 5 and the gas then flows through the deflecting elements of the various stages to the outflow stub 12, in the case of the exemplary embodiment illustrated in FIG. 5, an inlet stub 20 is situated at the one end 21 of the cup-shaped housing part 5 while an outlet stub 22 is arranged coaxially at the other end 23 of the cup-shaped housing part 5—or, conversely, on its pot-shaped head element 3. An outflow stub 12 branching off at right angles as in the case of the exemplary embodiment illustrated in FIG. 1 is therefore not absolutely necessary.

Also, the function of the supporting pipe 11, which serves at the same time as an inlet stub, in the exemplary embodiment according to FIG. 1 is omitted in the case of the muffler according to FIG. 5, since there a centrally arranged support or a supporting element 24 serves exclusively for supporting and/or connecting the muffler stages 25 comprising deflecting elements 13 to 16.

According to the exemplary embodiments illustrated in FIGS. 1 and 5, four or five muffler stages 25 are provided in each case. However, more or fewer muffler stages 25 may also be arranged along the central supporting element 24 in accordance with the particular conditions.

In addition, it is highly essential for the muffler according to the invention also to have only a very low flow resistance in comparison to conventional mufflers.

In principle, the deflecting elements may consist of metal and may have solid or permeable guiding elements, for example in the form of a fine-meshed ribbed mesh. Furthermore, plastics or composite materials are also suitable materials.

Finally, the deflecting elements 13 to 16' also prevent a back-surge in the muffler 1, which has a thermally favorable effect in the case of an internal combustion engine.

Also, the variable arrangement and the variable number of deflecting elements in conjunction with variable setting angles in a wide range of positive and negative sizes of angle also enable certain frequencies to be filtered out or intended vibrations to be produced. In terms of the valuable damping properties, the muffler is of comparatively simple and compact construction.

Furthermore, it is characteristic for those ends of the guiding elements 18 which are arranged at a distance from the main axis 19' of the housing to be angled more sharply than their ends which are situated near the main axis 19' of the housing and for the guiding elements 18 to be able to be at least partially twisted in themselves.

The invention is not restricted to the exemplary embodiments specifically illustrated in the figures; on the contrary, numerous modifications are possible without deviating from the basic concept of the invention.

The same also applies in principle to the manner in which the muffler is used with it not being restricted to certain internal combustion engines, but rather being able to be used very generally, this also applying in particular to its use for model aircraft and for engines having high speeds of rotation.

As emerges from the figures, the deflecting elements of the exemplary embodiments, which are in the manner of impellers, are preferably caused by production to have opposed, short slots 18" directed in the circumferential direction in the base region of the guiding elements 18, which are in the manner of guide vanes. As a result, each guiding element 18 is connected to the hub part 17 by just a narrow web which cannot be seen in the figures. The effect achieved by this is that, if the need arises, each guiding element 18 in the manner of an impeller can be given a completely flat, sheet-like shape in spite of the setting angle $\alpha$.

For strength reasons, after being slit in the circumferential region, the guiding elements 18 can additionally be soldered in the base region in a point-like manner to the hub part 17 and to the supporting pipe 11/to the supporting element 24.

The invention claimed is:

1. A muffler, for an internal combustion engine, the muffler comprising a housing (2) which is adapted to have a gaseous medium flow therethrough and which has at least one housing chamber (3, 5), and the muffler further comprising deflecting elements (13 to 16) that are adapted and arranged to make the gaseous medium swirl and that are arranged in a fixed manner spaced apart one behind another in the housing chamber along a main axis (19') of the housing, so that the deflecting elements are fixed stationary relative to the housing, wherein each one of the deflecting elements respectively comprises a disk-shaped body (17') having a set of radially extending guiding elements (18) being guide vanes as well as radially extending slots (18') respectively between the guide vanes, and extends over the clear cross section of the housing (2), wherein each one of the guide vanes has a free leading edge along one of the slots and a free trailing edge along another of the slots, wherein each one of the slots is respectively formed and bounded between the trailing edge of one of the guide vanes and the leading edge of a next adjacent one of the guide vanes of a respective one of the deflecting elements, and wherein the respective sets of guide vanes of successive adjacent ones of the deflecting elements along the main axis of the housing are respectively alternately oppositely angled at opposite pitch angles so as to be adapted to deflect the flow of the gaseous medium respectively alternately in opposite swirl directions about the main axis (19') of the housing respectively in successive portions of the housing chamber respectively between successive ones of the deflecting elements.

2. The muffler as claimed in claim 1, wherein the disk-shaped bodies (17') are in each case slotted rectilinearly.

3. The muffler as claimed in claim 1, wherein all of the guiding elements (18) of a disk-shaped body (17') are angled in the same direction.

4. The muffler as claimed in claim 1, wherein the pitch angle ($\alpha$) of the guiding elements (18) is alternately positive and negative respectively on successive ones of the deflecting elements.

5. The muffler as claimed in claim 1, wherein radially outer ends of the guiding elements (18) which are arranged at a distance from the main axis (19') of the housing are more sharply angled than radially inner ends of the guiding elements which are situated near the main axis (19') of the housing.

6. The muffler as claimed in claim 1, wherein the guiding elements (18) are at least partially twisted in themselves.

7. The muffler as claimed in claim 1, wherein the disk-shaped body (17') as a blank is in the form of a circular ring.

8. The muffler as claimed in claim 1, wherein the guiding elements (18) are each respectively in the form of a sector of a circular ring.

9. The muffler as claimed in claim 1, wherein the deflecting elements (13 to 16) are arranged with their guiding elements (18) between housing chamber parts which do not contain deflecting elements.

10. The muffler as claimed in claim 1, wherein each of the deflecting elements (13 to 16) respectively forms a respective muffler stage.

11. The muffler as claimed in claim 1, comprising the arrangement of at least three of the deflecting elements (13 to 16) each forming a muffler stage.

12. The muffler as claimed in claim l, wherein each deflecting element has approximately 10 to 40 guiding elements (18) which are each in the form of a sector of a circular ring in layout.

13. The muffler as claimed in claim 1, wherein the deflecting elements (13 to 16) each integrally have a hub part (17) with the slots (18') extending radially outwardly therefrom and with the guide vanes extending integrally radially outwardly therefrom.

14. The muffler as claimed in claim 1, wherein the deflecting elements (13 to 16) are in each case arranged on a supporting pipe (11) which conducts the gaseous medium.

15. The muffler as claimed in claim 1, wherein the deflecting elements (13 to 16) are manufactured in each case as disk-shaped bodies (17') from flat sheet-metal rings forming disk blanks in which the slots are formed as narrow slots (18') which extend radially and rectilinearly from the outside to the inside.

16. The muffler as claimed in claim 1, wherein the pitch angles of successive ones of the deflecting elements which are inclined in opposite directions have the same absolute angular value.

17. The muffler as claimed in claim 1, wherein the deflecting elements (13 to 16) are arranged with a hub part (17) on a supporting element (11) arranged centrally in the housing (2).

18. The muffler as claimed in claim 1, wherein an axial length of the housing (2) or at least of a housing part (3, 5) is dimensioned in such a manner that a number of deflecting elements (13 to 16) adapted to a particular application can be fitted therein.

19. A combination comprising the muffler as claimed in claim 1 connected to an internal combustion engine of a model aircraft.

20. The muffler as claimed in claim 1, wherein each one of the deflecting elements further includes a hub from which the guide vanes extend radially outwardly, and wherein the guide vanes are connected to the hub only at respective radially inner root ends of the guide vanes and are otherwise not connected to one another in the respective deflecting element.

21. The muffler as claimed in claim 1, wherein at least a portion of the housing chamber is a gaseous medium calming section that is hollow and unoccupied by the deflecting elements.

22. An exhaust gas muffler for muffling exhaust gas of an internal combustion engine, said muffler comprising:

a cylindrical housing that extends along an axis and that surrounds a muffler chamber therein;

a gas inlet pipe that has a gas inlet port and a gas introduction opening respectively at opposite ends thereof, and that extends from said gas inlet port along said axis through a first end of said housing into said muffler chamber toward a second end of said housing so that said gas introduction opening communicates into said muffler chamber;

a gas outlet that communicates out of said muffler chamber through said housing relatively proximate to said first end and distal from said second end of said housing; and a plurality of deflecting disks that are arranged spaced apart from one another successively along said axis and are each non-rotatably fixed to said gas inlet pipe so that said deflecting disks are stationary relative to said housing;

wherein:

each one of said deflecting disks respectively comprises a central hub through which said gas inlet pipe extends and which is non-rotatably fixed to said gas inlet pipe;

each one of said deflecting disks respectively further comprises a respective set of plural guide vanes extending radially outwardly from said central hub, with open slots extending radially outwardly from said central hub respectively between a free trailing edge of a respective one of said guide vanes and a free leading edge of a next adjacent one of said guide vanes;

said respective sets of guide vanes of successive adjacent ones of said deflecting disks along said axis are respectively alternately oppositely angled at opposite pitch angles about radially extending lines so as to be adapted to deflect a flow of exhaust gas alternately in opposite swirl directions about said axis between successive ones of said deflecting disks along said axis in a direction from said second end toward said first end of said housing.

23. The exhaust gas muffler according to claim 22, wherein each one of said slots is respectively a rectilinear slot formed by a single straight-line cut separating said trailing edge of a respective one of said guide vanes from said leading edge of a next adjacent one of said guide vanes.

* * * * *

UNITED STATES PATENT AND TRADEMARK OFFICE

CERTIFICATE OF CORRECTION

PATENT NO. : 7,073,626 B2
APPLICATION NO. : 10/615148
DATED : July 11, 2006
INVENTOR(S) : Weinhold et al.

It is certified that error appears in the above-identified patent and that said Letters Patent is hereby corrected as shown below:

Column 1,
Line 26, after "disks", delete ",";

Column 2,
Line 57, after "at its one end", start a new paragraph;

Column 3,
Line 24, after "or", replace "nonpositive" by --non-positive--;
Line 25, after "pipe", replace "12" by --11--;
Line 64, after "illustrations", replace "int he" by --in the--;
Line 66, before "having", replace "deflectisng elemnts" by --deflecting elements--;

Signed and Sealed this

Twenty-seventh Day of February, 2007

JON W. DUDAS
*Director of the United States Patent and Trademark Office*